US005619922A

United States Patent [19]

Kelm

[11] Patent Number: 5,619,922

[45] Date of Patent: Apr. 15, 1997

[54] DEVICE FOR MOVING ROLLERS IN A PRINTING PRESS

[75] Inventor: Carsten Kelm, Mannheim, Germany

[73] Assignee: Heidelberger Druckmaschinen Aktiengesellschaft, Heidelberg, Germany

[21] Appl. No.: 563,060

[22] Filed: Nov. 27, 1995

[30] Foreign Application Priority Data

Nov. 28, 1994 [DE] Germany ..... 44 42 302.0

[51] Int. Cl.[6] ..... B41F 5/00

[52] U.S. Cl. ..... 101/216; 101/148; 101/348; 101/DIG. 38

[58] Field of Search ..... 101/DIG. 38, 348, 101/349, 350, 148, 216

[56] References Cited

U.S. PATENT DOCUMENTS

| | | | |
|---|---|---|---|
| 1,326,537 | 12/1919 | Smith | 101/DIG. 38 |
| 1,396,110 | 11/1921 | Hentschel | 101/DIG. 38 |
| 1,427,988 | 9/1922 | Waters | 101/DIG. 38 |
| 4,332,195 | 6/1982 | Mizumura . | |
| 4,513,663 | 4/1985 | Hummel et al. . | |
| 4,833,987 | 5/1989 | Hardin | 101/348 |
| 5,027,704 | 7/1991 | Holl et al. | 101/349 |
| 5,060,568 | 10/1991 | Jentzsch et al. | 101/148 |

FOREIGN PATENT DOCUMENTS

| | | | |
|---|---|---|---|
| 0110032 | 6/1984 | European Pat. Off. | 101/DIG. 38 |
| 2514414 | 10/1976 | Germany . | |
| 0222356 | 12/1984 | Japan | 101/DIG. 38 |
| 0244161 | 12/1925 | United Kingdom | 101/DIG. 38 |
| 0928775 | 6/1963 | United Kingdom . | |
| 1102249 | 2/1968 | United Kingdom . | |
| 2097505 | 11/1982 | United Kingdom . | |
| 2180502 | 4/1987 | United Kingdom . | |

*Primary Examiner*—Eugene H. Eickholt
*Attorney, Agent, or Firm*—Nils H. Ljungman and Associates

[57] ABSTRACT

The invention relates to a device for moving rollers in a printing press comprising a device for setting the stroke length during machine run and means for synchronously adjusting the movement of the roller.

24 Claims, 5 Drawing Sheets

DEVICE FOR MOVING ROLLERS IN A PRINTING PRESS

BACKGROUND OF THE INVENTION

1. Field of the Invention

The present invention generally relates to a device for moving rollers in a printing press.

2. Background Information

Generally, a printing unit of a printing press will have disposed therein a plurality of rollers mounted for rotation within the printing unit. In order for a successful printing run to be undertaken, it is generally important that these rollers be able to move in a substantially unhindered manner.

It has often been the case that restricted movement of rollers can potentially provide detrimental effects in operating a printing unit of a printing press. Although the restrictions on the movement of a roller could possibly arise from any number of factors, it is generally recognized that greater freedom of movement, for the rollers, will provide markedly improved printing results.

Typically, the rollers of a printing unit are arranged in a chain, usually extending from the upper portion of the printing unit to the region of the plate cylinder and blanket cylinder. Various possible arrangements are feasible with regard to such chains of rollers, and in many instances, a chain of rollers can involve a relatively complicated structure. On the other hand, chains of rollers having a simpler pattern have been used.

Typically, one or more of the rollers of a printing unit will be mounted only for rotational movement. Thus, such rollers will typically extend between the sides of the frame of the printing unit in question, and will usually be mounted in a simple rotational bearing in the sides of the printing unit frame. Accordingly, such rotational bearings may, for the most part, be considered to be fixed, involving no more complicated a structure than that which is necessary to simply hold portions or extensions of a roller in place, only allowing such portions or extensions of a roller to rotate. As a result, rollers mounted in such a manner will generally be hindered from moving in a translational manner, that is, in a manner that would effectively involve movement of the rotational axis of the roller in question. Such rollers also will typically be hindered from being displaced axially, that is, in a linear direction that is parallel to the rotational axis of the roller.

On the other hand, it is known to permit a selected roller or rollers of a printing unit to be movable not only in a rotational direction but also in an axial direction. Such axial movement can also be permitted while the roller is rotating, thereby allowing the roller to undergo a simultaneous rotational and axial displacement during operation of the printing unit. Depending on the positioning of such a roller relative to other rollers in the printing unit, such a roller may be termed a "distributor roller". Distributor rollers, per se, are quite well-known and may involve any of a wide variety of arrangements for affording axial displacement of the same simultaneously with rotational displacement.

On printing forms which have different surface coverages in the individual ink zones, one problem is that the desired thickness of the ink in the zones which have only a very low ink coverage tends to be overrun by the neighboring zones which have a higher ink coverage, and the result is an undesirable equalization of the thicknesses of the ink layers.

The same problem occurs if, while the printing machine is running, brief interruptions in printing are necessary, during which the paper feed and ink feed are briefly shut off and the inking unit continues to rotate. In these situations, the result is an ink profile across the width of the inking unit which is modified by the lateral spreading of the ink by rubbing, to the extent that the ink profile achieved on the printing plate hardly has anything to do with the actual ink requirement.

To correct these problems, German Patent No. 41 40 048 A1 teaches that the drive of a distributor roller can be interrupted by means of a clutch, so that the periodic axial motion of the distributor roller can be stopped. The disadvantage of this known solution is that it presents problems in terms of the re-engagement of the distributing rollers in the correct phase when printing resumes, e.g. once the interruption in the printing is over and the paper feed is resumed. If there are several distributing rollers in an inking unit, these distributing rollers normally do not tend to execute their axial stroke in synchronization, which means that they require quite a complex control system to re-establish the previously specified axial stroke. A modification of the axial stroke movement of the individual distributing rollers would likely have a direct effect on the result of the printing, and would lead to an undesirable change in the ink profile achieved.

With a known device of this type (German Patent No. 25 14 414 C3) a separate drive cylinder is used to reciprocate distributor rollers, wherein the drive cylinder axially reciprocates distributor rollers via a lever arrangement in connection with a bell-crank lever and a thrust rod. In this case, the drive cylinder is driven by a separate drive, a prerequisite being a control unit ensuring that the drive is synchronized with the machine speed. The conventional solution includes a large number of bearings which may cause clearance, or play, especially at the point of reversal of a respective distributor roller. This may be disadvantageous to the inking of the printing plate. Furthermore, this known solution requires considerable structural efforts with regard to the drive problems, thus inevitably involving high costs. In addition, connecting several distributor rollers is essentially not novel in printing-machine engineering.

OBJECT OF THE INVENTION

Proceeding from the known arrangements discussed above, it is an object of the present invention to provide a simple and reliable solution being continuously synchronized with the machine speed and enabling an optimum machine control by means of remote control.

SUMMARY OF THE INVENTION

According to the present invention, the above object can be achieved, in accordance with at least one preferred embodiment, in that the axial stroke of the distributor roller is effected via a roller being mounted on the machine side frame, the roller being perpendicularly adjustable with respect to the longitudinal axis of the distributor roller, and the roller being movable between two contact surfaces running parallel to each other. The two contact surfaces are provided on a crank-type swing executing a pendulum motion about a point of rotation, and, in the range between the point of rotation of the two contact surfaces and a maximum stroke of the distributor roller, the roller is adjustable via an adjusting means. This solution makes it possible to reset the stroke of the distributor roller easily and quickly to zero and to change the stroke of the distributor roller steplessly from standstill to a maximum position, the adjustment of the axial stroke being possible at standstill and during machine run.

In an advantageous embodiment of the present invention, the point of rotation of the crank-type swing is provided on a housing mounted on the pivot of the distributor roller, the crank-type swing is driven via a gear, preferably a worm gear, and a connecting rod is provided so as to execute an oscillating movement, with the gear being provided in the housing. Such a drive of the crank-type swing is easy to design, is of compact structure, and features only few bearings with clearance, or play. Moreover, each distributor roller may be adjusted individually.

A further advantageous embodiment of the invention is characterized in that the roller is adjustable in a guide rail perpendicularly with respect to the longitudinal axis of the distributor roller, and that a pneumatic cylinder serves as an adjusting means, the adjusting path being limited by means of stops. One of the stops, being adjustable itself, adjusts the stroke of the distributor roller. According to at least one preferred embodiment of the present invention, the adjustable stop is designed as a threaded spindle connected to a servomotor via a pair of spur gears. This makes it possible for the pressman to control the distributor roller according to the respective print-specific conditions, for example, via the control console (i.e. he no longer has to manually effect an uncontrolled change in the given setting, for example, by means of a handwheel).

Further details of the present invention will be discussed hereinbelow with reference to the accompanying figures. It should be understood that when the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

In summary, one aspect of the invention resides broadly in a printing press comprising a frame, a plate cylinder being rotatably mounted with respect to the frame, a blanket cylinder being rotatably mounted with respect to the frame and having means for being engaged with the plate cylinder during operation of the printing press, at least one roller having a rotational axis and being mounted, with respect to the frame, for rotation about the rotational axis, and means for rotating at least one roller about the rotational axis, apparatus for displacing at least one roller, the apparatus comprising: means for displacing at least one roller, simultaneously with the rotation of at least one roller, in a direction substantially parallel to the rotational axis of at least one roller, to laterally oscillate at least one roller over a determinable lateral stroke; the means for displacing comprising: means for varying the determinable lateral stroke of at least one roller during the running of the printing press and the rotation of at least one roller; the means for varying the determinable lateral stroke comprising means for determining the determinable lateral stroke; the varying means comprising means for varying the stroke of at least one roller over a substantial portion of a maximum stroke of at least one roller during the running of the printing press and rotation of at least one roller, and changing the stroke of at least one roller from a minimal stroke to a maximum stroke; and the varying means comprising means for transmitting a pendulum motion to at least one portion of the means for displacing during the running of the printing press and rotation of at least one roller.

Another aspect of the invention resides broadly in an apparatus for displacing at least one roller in a printing press, the apparatus for displacing at least one roller comprising: means for displacing at least one roller, simultaneously with the rotation of at least one roller, in a direction substantially parallel to the rotational axis of at least one roller, to laterally oscillate at least one roller over a determinable lateral stroke; the means for displacing comprising: means for varying the determinable lateral stroke of at least one roller during the running of the printing press and the rotation of at least one roller; the means for varying the determinable lateral stroke comprising means for determining the determinable lateral stroke; the varying means comprising means for varying the stroke of at least one roller over a substantial portion of a maximum stroke of at least one roller during the running of the printing press and rotation of at least one roller, and changing the stroke of at least one roller from a minimal stroke to a maximum stroke; and the varying means comprising means for transmitting a pendulum motion to at least one portion of the means for displacing during the running of the printing press and rotation of at least one roller.

BRIEF DESCRIPTION OF THE DRAWINGS

An embodiment of the invention is described in greater detail below and is schematically illustrated in the accompanying drawings.

DESCRIPTION OF THE PREFERRED EMBODIMENT

Figure 1:
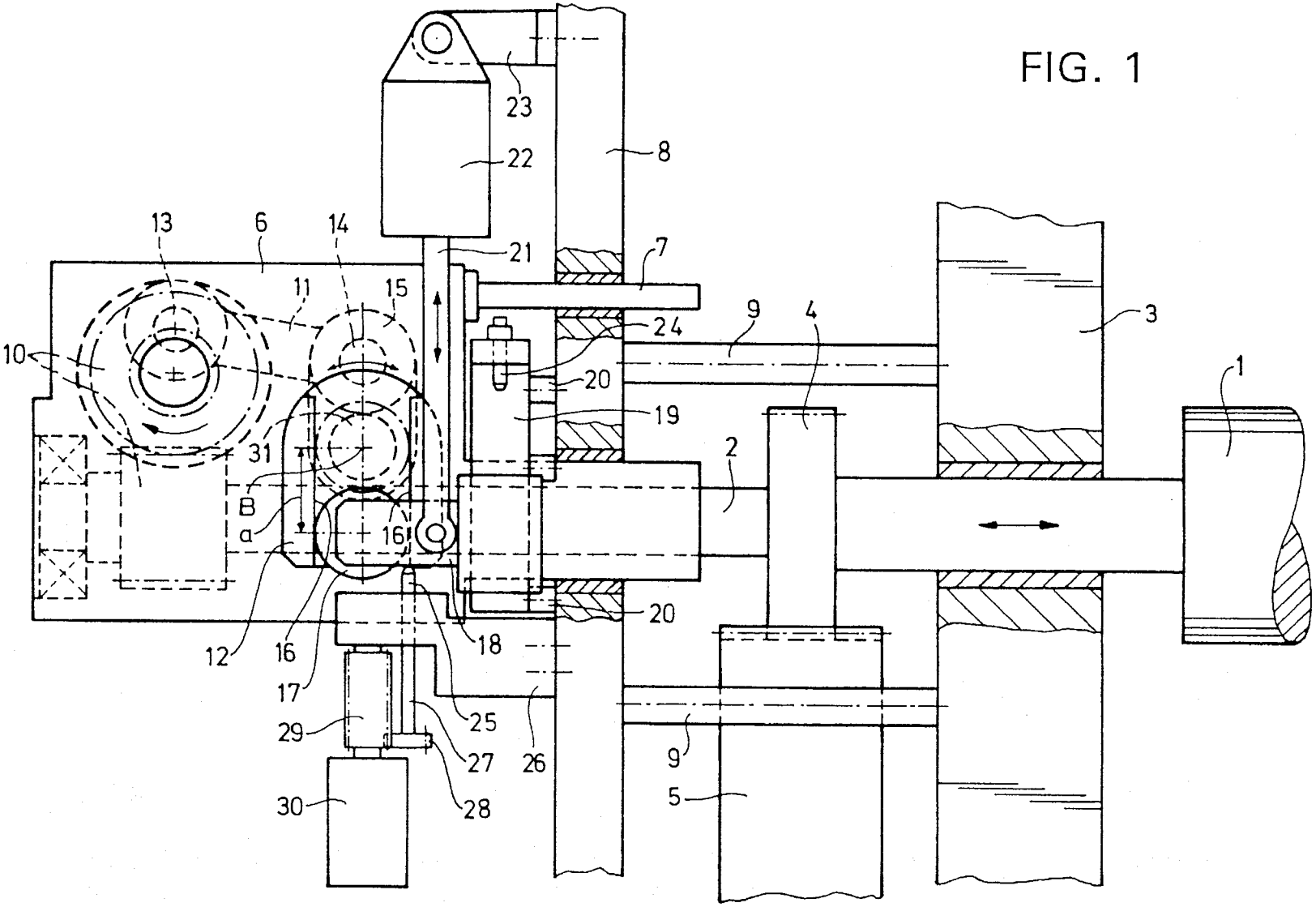
FIG. 1 shows a diagram of the device.

In accordance with at least one preferred embodiment of the present invention, a distributor roller 1 and its pivot 2 can preferably be supported in the machine side free 3 so as to perform an axial reciprocating motion as well as a rotary motion. The drive of the distributor roller 1 can be effected via a spur gear 4 meshing with a spur gear 5 of the inking unit. Spur gear 4 would be driven by spur gear 5, thus imparting a rotary motion to the distributor roller 1.

At the end of the pivot 2 there can be mounted a housing 6, which housing 6 could preferably move axially back and forth together with the distributor roller 1. Via a guide bar 7, the housing 6 can essentially be fixed against rotation. According to the stroke of the distributor roller 1, the guide bar 7 would move axially back and forth in a bearing plate 8 preferably fastened to the machine side frame 3 via stay bolts 9. A worm gear 10, preferably driven by the pivot 2 of the distributor roller 1, can be located in the housing 6. The worm gear 10 would drive a connecting rod 11, which connecting rod 11, in turn, would cause a crank-type swing 12 to execute an oscillating motion. The crank-type swing 12, additionally, could be supported in the housing 6 so as to perform an essentially pendulum motion. In this case, the connecting rod 11 would preferably be mounted, with one end thereof, on a pin 13, the pin 13 preferably being provided on the worm gear 10 so as to be eccentrically offset, whereas the other end of the connecting rod 11 can be mounted on a pivot 14, which pivot 14 would be fastened to a swinging lever 15, which swinging lever 15, in turn, would drive the crank-type swing 12.

The crank-type swing 12 can preferably feature two contact surfaces 16 running essentially parallel to each other, between which two contact surfaces 16 there can be provided a roller 17 preferably fixed to a mounting support 18. The mounting support 18 can be displaced on a guide rail 19 essentially parallel to the machine side frame 3 and the bearing plate 8, respectively. The guide rail 19 can be fastened to the bearing plate 8 via bolts 20. Thus, the roller 17 can preferably be mounted on the machine side frame 3 vie mounting support 18, guide rail 19 and bearing plate 8.

The thrust rod 21 of an adjusting means 22 can act on the mounting support 18 of the roller 17, with the adjusting means 22 preferably being supported on the bearing plate 8 via a supporting bearing 23. The adjusting means 22 may be a pneumatic cylinder, for example, via which the roller 17 may be displaced by a distance "a". The guide rail 19 may preferably feature a first stop 24 against which first stop 24 the mounting support 18 would abut, if the center of roller 17 would coincide with the point of rotation "B" of the crank-type swing 12. A second adjustable stop 25 can preferably be provided on a bearing body 26 and designed as a threaded spindle 27. The threaded spindle 27 can preferably extend through the bearing body 26 and preferably be connected to a servomotor 30 via a pair of spur gears 28 and 29, with the servomotor 30 being also mounted on the bearing body 26 (not illustrated). Via the servomotor 30, the second stop 25 may be changed with respect to the maximum position shown in FIG. 1, by turning the threaded spindle 27 until the center of roller 17 would coincide with the swivel point "B". Similar to the servomotor 30, the adjusting means 22 may be remote-controlled, as a result of which remote control a respective position of the roller 17 may be steplessly changed between both end positions.

By turning the distributor roller 1, a worm gear 10 can preferably impart to the connecting rod 11 a reciprocating motion, preferably causing the pin 14 and the swinging lever 15 to execute a pendulum motion, which pendulum motion, via an axle, spindle or shaft 31, would then be transmitted onto the crank-type swing 12. Thereafter, the crank-type swing 12 will preferably perform a pendulum motion about the point of rotation "B". Depending on the position of the roller 17 in the area "a", the pendulum motion of the crank-type swing 12 could be transformed into a reciprocating motion, while the roller 17 is firmly supported with respect to the machine side frame 3, seen in axial direction of the distributor roller 1. The pendulum motion of the crank-type swing 12 may now be imparted onto the point of rotation "B" and thus onto the housing 6, which housing 6 is preferably mounted on the pivot 2 of the distributor roller 1 so as to be rotatable but not axially displaceable. Thus, the pivot 2 moves back and forth, with the stroke corresponding to the respective setting of stop 25. If roller 17 is positioned at point "B", essentially no axial motion will be transmitted onto the distributor roller 1.

Figure 1A:
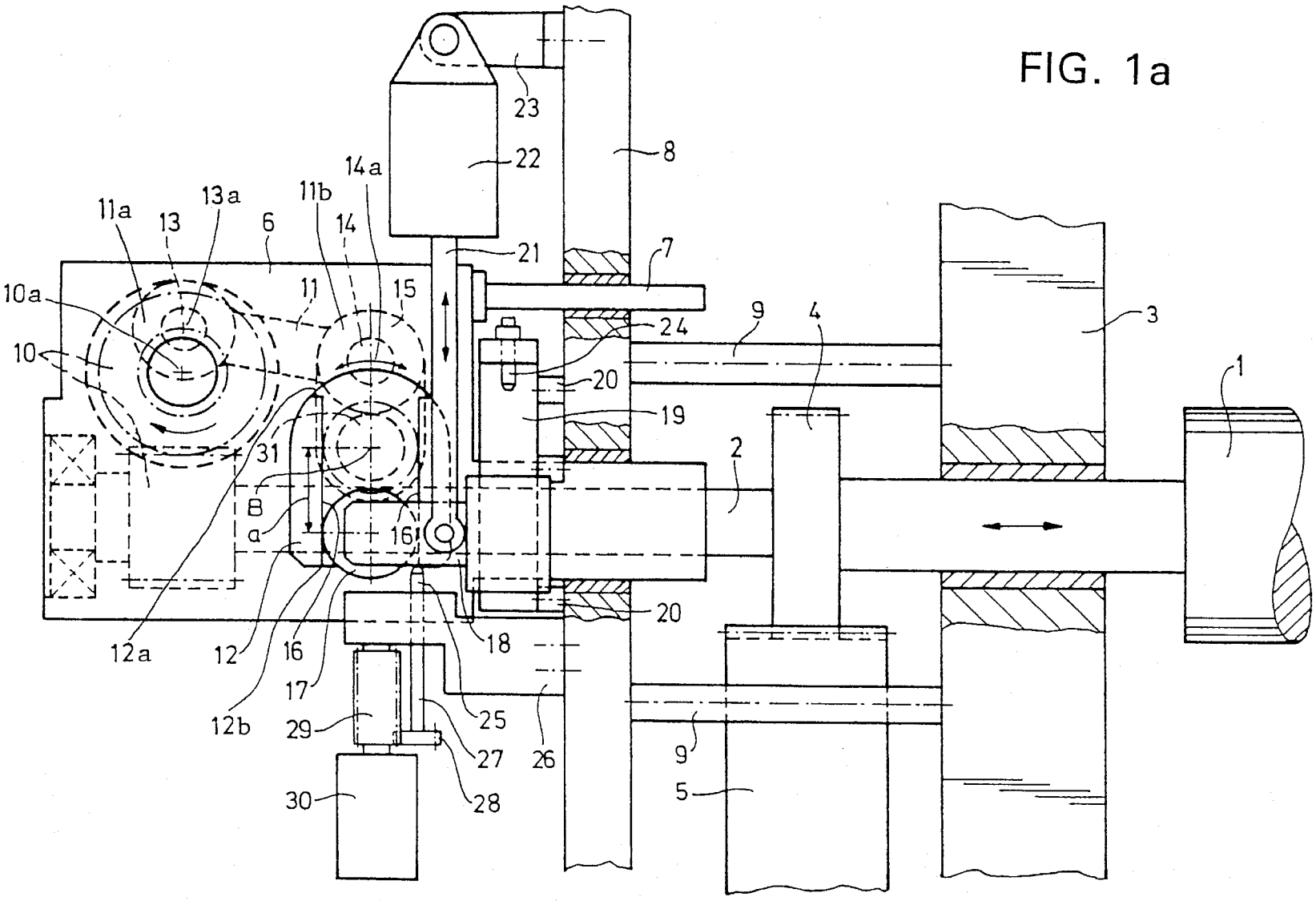
FIG. 1*a* and 1*b* are essentially the same as FIG. 1, but show additional details.

As shown in FIG. 1*a*, in one embodiment of the present invention, a first end 11*a* of connecting rod 11 can be rotationally mounted by means of pin 13 to worm gear 10. The mounting of first end 11*a* of connecting rod 11 is preferably offset from the axis of rotation 10*a* of the worm gear 10. The axis of rotation 13*a* of the first end 11*a* of connecting rod 11, upon rotation of worm gear 10, essentially defines an orbital path around the axis of rotation 10*a* of worm gear 10, thus causing the second end 11*b* of connecting rod 11 to move. The second end 11*b* of connecting rod 11 is preferably rotatably connected to swinging lever 15 by means of a pin 14. The crank-type swing 12 can be mounted on swinging lever 15. The assembly of pin 14, swinging lever 15 and crank-type swing 12 would preferably have a common axis of rotation "B"; in this embodiment, the axis of rotation 14*a* at pin 14 is offset from the axis of rotation "B".

As the first end 11*a* of connecting rod 11 orbits around the axis 10*a* of worm gear 10, the second end 11*b* of connecting rod 11, as noted above, preferably moves. The movement of the second end 11*b* of connecting rod 11, however, would not then be an orbital movement, but an oscillating movement. By means of pin 14, the oscillating movement of connecting rod 11 is then preferably transferred to swing-type crank 12 in a manner, such that, for every movement of a first end 12*a* of swing-type crank 12 in one direction, the axis of rotation "B" acts as a pivotal axis and a second end 12*b* of swing-type crank 12 reacts with a pendulum motion from axis "B" and moves in a general linear direction substantially opposite to the direction of movement of e first end 12*a* of crank-type swing 12. The housing 6 is mounted to pivot 2; a second end 12*b* of crank-type swing 12 would preferably transfer pendulum motion to pivot or shaft 2 via roller 17, which roller 17 is connected to mounting support 18, which mounting support 18 is connected to pivot 2. Thus, the pendulum motion of crank-type swing 12 would then be transferred to the housing 6 via the mounting of housing 6 on the pivot 2. Even though the crank-type swing 12 would preferably be rotatable about the axis "B", the crank-type swing 12 in contact with roller 17 preferably would not be axially displaceable with respect to the bearing plate 8.

Figure 1B:
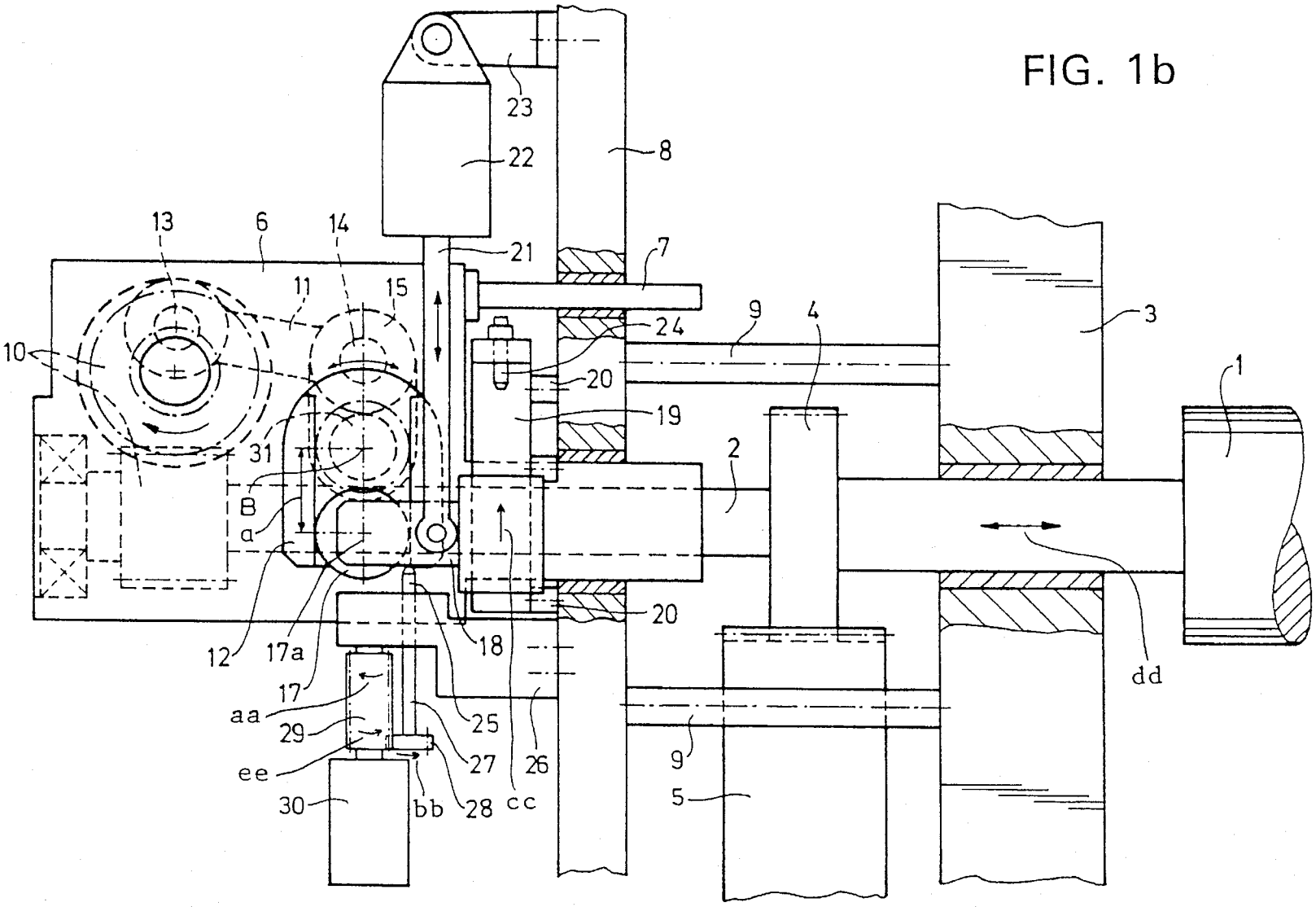

FIG. 1*b* shows details of an embodiment of the present invention, particularly showing an example of the operation of stop 25. In this embodiment, spur gear 29, of servomotor 30, can preferably mesh with spur gear 28 of stop 25. The threaded spindle 27 of stop 25 can be right-hand threaded, with the bearing body 16 having mating threads where the threaded spindle 25 passes through bearing body 26. As servomotor 30 turns spur gear 29 in the direction of arrow "aa", the spur gear 28, being in mesh with spur gear 29, turns in the direction of arrow "bb", the direction of arrow "bb" in this embodiment being a right-hand direction. The threaded spindle 25 is then driven in direction of arrow "cc". The stop 25 would then engage mounting support 18, and mounting support 18, being guided by guide rail 19, would thus be adjusted in the direction of arrow "cc" as stop 25 moves in the direction of arrow "cc". Roller 17 is mounted on mounting support 18 and moves with mounting support 18; thus, as mounting support 18 moves in the direction of arrow "cc", roller 17 moves likewise. The axis of rotation 17*a* of roller 17, then, approaches the point of rotation "B" as roller 17 moves in the direction indicated by arrow "cc", thus shortening the distance "a". As distance "a" shortens, the longitudinal distance of travel, or axial stroke "dd" of roller 1 lessens. According to this embodiment, as spur gear 29 would turn in the direction of arrow "ee", the process as described herein would be reversed, thus lengthening the axial stroke "dd" of roller 1.

In a variant embodiment of the operation of stop 25, the threaded spindle 27 could be left-hand threaded; in this case, spur gear 29 would turn in direction "ee" in order to shorten the axial stroke "dd" of roller 1, as described in the embodiment hereinabove.

Figure 2:
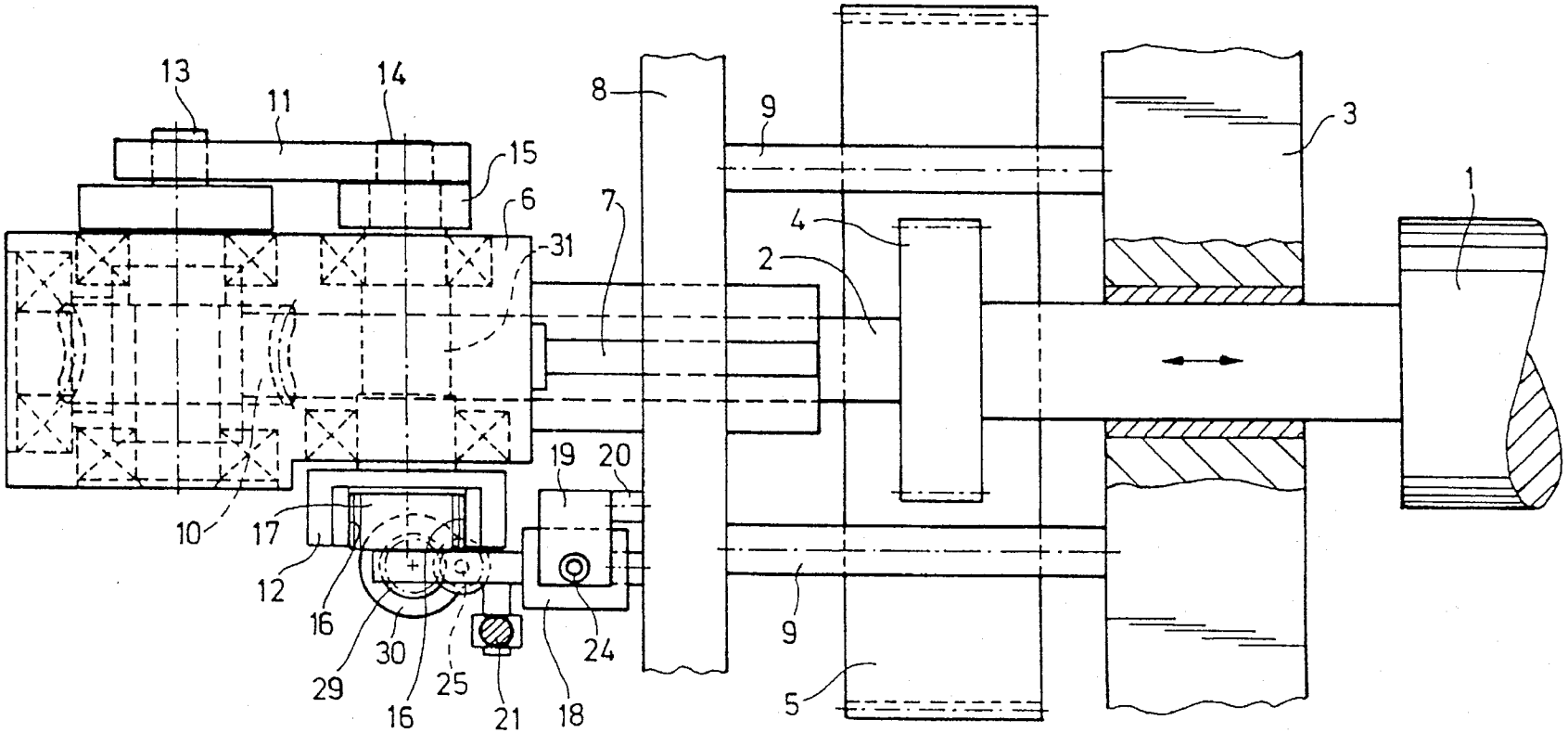
FIG. 2 is a side elevational view of the device.
Figure 2A:
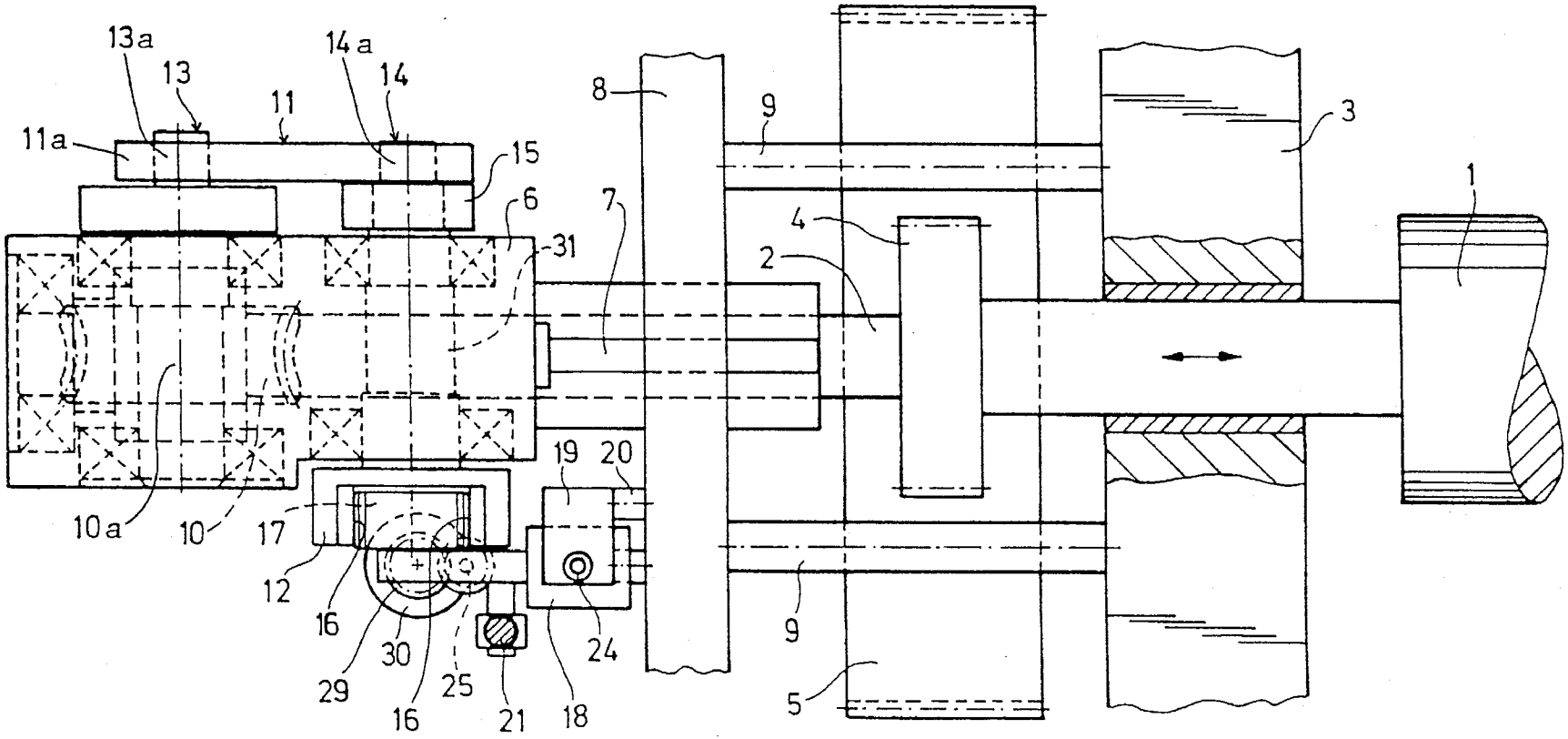
FIG. 2*a* is essentially the same as FIG. 2, but shows additional details.

Referring now to FIG. 2*a*, the connecting rod 11 is shown, with the first end 11*a* of connecting rod 11 being rotatably connected to worm gear 10 by means of pin 13. The second end 11*b* of connecting rod 11 is rotatably connected by means of pin 14 to swinging lever 15; swinging lever 15, in turn, is fixedly connected to the axle, shaft, or spindle 31. The axle, shaft, or spindle 31 is fixedly connected with swinging lever 15, and swinging lever 15 is fixedly connected with swing-type crank 12. The combination of the axle, shaft, or spindle 31, swinging lever 15, and swing-type crank 12 essentially acts, therefore, as a single operating unit; axis "B" being, or essentially being, the common axis of rotation for the aforementioned combination.

A typical arrangement of rollers and cylinders that could conceivably be used in conjunction with at least one preferred embodiment of the present invention is described in detail with relation to FIG. 1 of U.S. Pat. No. 5,081,926, which issued to Rodi on Jan. 21, 1992. This U.S. Patent is hereby incorporated by reference herein. distributor rollers in FIG. 1 of U.S. Pat. No. 5,081,926, could each employ an arrangement such as that described and illustrated heretofore with relation to FIGS. 1–2*a*.

If not otherwise stated hereabove, it should generally be understood that the components and methods discussed above with relation to FIG. 1 of U.S. Pat. No. 5,081,926, may, if appropriate, essentially be considered to be interchangeable with similar components and methods discussed further above with relation to FIGS. 1–2*a*.

One feature of the invention resides broadly in the device for axially reciprocating distributor rollers in an inking unit of a printing machine comprising a device for adjusting the stroke length during the machine run, characterized in that the axial stroke of distributor roller 1 is effected by a roller 17 being adjustable perpendicularly with respect to the longitudinal axis of said distributor roller 1 and being mounted on a machine side free 3, the roller 17 being movable between two contact surfaces 16 running parallel to each other, that the two contact surfaces 16 are provided on a crank-type swing 12 executing a pendulum motion about a point of rotation B, and that, via an adjusting means 22 the roller 17 is adjustable from the point of rotation B of the two contact surfaces 16 to the maximum stroke of distributor roller 1.

Another feature of the invention resides broadly in the device characterized in that the point of rotation of the crank-type swing 12 is provided on a housing 6 mounted on a pivot 2 of the distributor roller 1, that the crank-type swing 12 is driven via a gear 10, preferably a worm gear, and a connecting rod 11, the crank-type swing 12 executing an oscillating motion, with the gear 10 being located in the housing 6.

Yet another feature of the invention resides broadly in the device characterized in that the roller 17 is adjustable in a guide rail 19 perpendicularly with respect to the longitudinal axis of the distributor roller 1, and that a pneumatic cylinder serves as an adjusting means 22, with the adjusting path being limited by stops 24, 25; stop 25 being adjustable for adjusting the stroke of the distributor roller 1.

Still another feature of the invention resides broadly in the device characterized in that the adjustable stop 25 is designed as threaded spindle 27 connected to a servomotor 30 via a pair of spur gears 28, 29.

Examples of printing presses, which may be utilized in accordance with the embodiments of the present invention, may be found in the following U.S. patents: U.S. Pat. No. 5,170,706, which issued to Rodi et al. on Dec. 15, 1992; U.S. Pat. No. 5,081,926, which issued to Rodi on Jan. 21, 1992; and U.S. Pat. No. 5,010,820, which issued to Löffler on Apr. 30, 1991.

Examples of distributor rollers, and arrangements for ensuring axial displacement of such distributor rollers, which may be utilized in accordance with the embodiments of the present invention, may be found in the following U.S. Patents: U.S. Pat. No. 5,003,874, which issued to Junghans on Apr. 2, 1991; U.S. Pat. No. 3,118,373, which issued to Mossmiller on Jan. 21, 1964; and U.S. Pat. No. 4,332,192, which issued to Mizumura on Jun. 1, 1982.

Examples of general concepts and principles relating to the establishment of ink zone profiles in printing presses may be found in the following U.S. Patents: U.S. Pat. No. 5,174,210, which issued to Rodi et el. on Dec. 29, 1992; U.S. Pat. No. 5,081,926, which issued to Rodi on Jan. 21, 1992; and U.S. Pat. No. 5,010,820, which issued to Löffler on Apr. 30, 1991.

Examples of printing presses, which may be utilized in accordance with the embodiments of the present invention, may be found in the following U.S. Patents: U.S. Pat. No. 5,170,706, which issued to Rodi et al. on Dec. 15, 1992; U.S. Pat. No. 5,081,926, which issued to Rodi on Jan. 21, 1992; and U.S. Pat. No. 5,010,820, which issued to Löffler on Apr. 30, 1991.

Examples of distributor rollers, and arrangements for ensuring axial displacement of such distributor rollers, which may be utilized in accordance with the embodiments of the present invention, may be found in the following U.S. Patents: U.S. Pat. No. 5,003,874, which issued to Junghans on Apr. 2, 1991; U.S. Pat. No. 3,118,373, which issued to Mossmiller on Jan. 21, 1964; and U.S. Pat. No. 4,332,195, which issued to Mizumura on Jun. 1, 1982.

In recapitulation, the present invention can generally relate to a device for axially reciprocating distributor rollers in an inking unit of a printing machine comprising a device for adjusting the stroke length during machine run.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the U.S. patents recited herein, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. In a printing press comprising a frame, a plate cylinder being rotatably mounted with respect to said frame, a blanket cylinder being rotatably mounted with respect to said frame and having means for being engaged with said plate cylinder during operation of said printing press, at least one roller having a rotational axis and being mounted, with respect to said frame, for rotation about the rotational axis, and means for rotating said at least one roller about the rotational axis, apparatus for displacing said at least one roller, said apparatus comprising:

means for displacing said at least one roller, simultaneously with the rotation of said at least one roller, in a direction substantially parallel to the rotational axis of said at least one roller, to laterally oscillate said at least one roller over a determinable lateral stroke;

said means for displacing comprising:

means for varying the determinable lateral stroke of said at least one roller during the running of said printing press and the rotation of said at least one roller;

said means for varying the determinable lateral stroke comprising means for determining the determinable lateral stroke;

said varying means comprising means for varying the stroke of said at least one roller over a substantial portion of a maximum stroke of said at least one roller during the running of said printing press and rotation of said at least one roller, and changing the stroke of said at least one roller from a minimal stroke to a maximum stroke; and said varying means comprising means for transmitting a pendulum motion to at least one portion of said means for displacing during the running of said printing press and rotation of said at least one roller.

2. In a printing press, according to claim 1, wherein:

said means for transmitting a pendulum motion comprises crank means, said crank means comprising a shaft having an axis of rotation;

said means for transmitting a pendulum motion comprising two contact surfaces;

said two contact surfaces being connected to said crank means;

said means for transmitting further comprises a swinging lever;

said crank means being connected to said swinging lever; and said two contact surfaces comprising means for receiving a pendulum motion and imparting a motion.

3. In a printing press, according to claim 2, wherein said crank means comprises means for accepting a pendulum motion from said two contact surfaces and converting the accepted pendulum motion to a linear stroke motion to be imparted to said at least one roller.

4. In a printing press, according to claim 3, wherein:

said means for transmitting comprises at least one contact roller, said at least one contact roller having an axis of rotation, the rotational axis of said at least one contact roller being disposed essentially perpendicularly with respect to the rotational axis of said at least one roller; and said at least one contact roller being disposed between said two contact surfaces and being disposed immediately adjacent at least one of said two contact surfaces.

5. In a printing press, according to claim 4, wherein said two contact surfaces comprise two planar contact surfaces, said two planar contact surfaces being disposed substantially in parallel with respect to one another.

6. In a printing press, according to claim 5, wherein:

said at least one roller comprises one roller;

said one roller comprises a roller shaft;

said roller shaft having a longitudinal axis concentric with the rotational axis of said one roller;

said roller shaft comprises a first end and a second end;

said first end of said roller shaft is attached to said one roller;

said apparatus further comprises a housing being mounted about said roller shaft;

said shaft of said crank means comprises a pivot shaft, said pivot shaft being disposed in and rotationally mounted to said housing;

said swinging lever comprising a first portion, a second portion, end a central portion, said central portion being disposed between said first and second portions of said swinging lever; and said swinging lever being rotatably connected to said pivot shaft at said central portion of said swinging lever.

7. In a printing press, according to claim 6, wherein:

said means for transmitting further comprises gear means;

said gear means comprising a first portion and a second portion;

said first portion of said gear means comprising an outer surface, said outer surface of said first portion of said gear means comprising teeth;

said first portion of said gear means being mounted about said second end of said roller shaft and having an axis of rotation being concentric with the axis of rotation of said roller shaft;

said second portion of said gear means comprising an outer surface, said outer surface of said second portion of said gear means comprising teeth;

said second portion of said gear means being mounted on a shaft and having an axis of rotation;

said shaft being a gear shaft having an axis of rotation and said gear shaft being rotatably mounted in said housing;

the axis of rotation of said second portion of said gear means being concentric with the axis of rotation of said gear shaft; and said teeth of said first portion and said second portion of said gear means being in mesh.

8. In a printing press, according to claim 7, wherein said gear means comprises a worm gear.

9. In a printing press, according to claim 8, wherein:

said crank means comprises means for connecting said second portion of said gear means to said swinging lever;

said connecting means comprises a connecting rod, said connecting rod comprising a first end and a second end;

said first end of said connecting rod comprises a first connecting pin and said second end of said connecting rod comprises a second connecting pin;

said first end and said second end of said connecting rod each having an axis of rotation;

said first connecting pin being for connecting said first end of said connecting rod to said second portion of said gear means;

said first connecting pin having a longitudinal axis, the longitudinal axis of said first connecting pin being concentric with the axis of rotation of said first end of said connecting rod;

said first connecting pin being eccentrically offset from the axis of rotation of said second portion of said gear means;

said second connecting pin being for connecting said second end of said connecting rod to said second portion of said swinging lever;

said second connecting pin having a longitudinal axis, the longitudinal axis of said second connecting pin being concentric with the axis of rotation of said second end of said connecting rod; and said second connecting pin being eccentrically offset from the axis of rotation of said swinging lever.

10. In a printing press, according to claim 9, wherein:

said roller shaft comprises a contact roller support;

said means for varying the stroke of said one roller comprises means for displacing and guiding said contact roller support perpendicularly with respect to the rotational axis of said one roller;

said means for guiding comprising a guide rail;

said contact roller support being disposed on said guide rail;

said at least one contact roller being connected to said contact roller support;

said means for varying the stroke of said one roller comprises a pneumatic cylinder apparatus;

said pneumatic cylinder apparatus comprising a thrust rod, said thrust rod having a path of movement and being connected to said contact roller support;

said means for varying the stroke further comprises adjustable stop means, said stop means being for delimiting the path of movement of said thrust rod of said pneumatic cylinder apparatus;

said stop means comprises a first stop and a second stop, said second stop being adjustable for adjusting the stroke of said one roller;

said second stop comprises a first end, a second end, and a helically threaded spindle, said spindle being disposed between said first end and said second end of said second stop;

said first end of said second stop for abutting said contact roller support and limiting the path of movement of said thrust rod in at least one direction of movement along the path of movement and varying the stroke of said one roller;

said second end of said second stop comprises an outer circumferential surface, said surface comprising teeth;

said stop means further comprising means for adjusting said second stop;

said means for adjusting said second stop comprising a gear, said gear having teeth, and said teeth of said gear being in mesh with said teeth of said second end of said second stop;

said gear being driven by means for driving, said means for driving comprising a servomotor;

said one roller comprises a distributor roller; and said printing press further comprises an inking unit for providing ink to said distributor roller.

11. Apparatus for displacing at least one roller in a printing press, said apparatus for displacing said at least one roller comprising:

means for displacing said at least one roller, simultaneously with the rotation of said at least one roller, in a direction substantially parallel to the rotational axis of said at least one roller, to laterally oscillate said at least one roller over a determinable lateral stroke;

said means for displacing comprising:

means for varying the determinable lateral stroke of said at least one roller during the running of said printing press and the rotation of said at least one roller;

said means for varying the determinable lateral stroke comprising means for determining the determinable lateral stroke;

said varying means comprising means for varying the stroke of said at least one roller over a substantial portion of a maximum stroke of said at least one roller during the running of said printing press and rotation of said at least one roller, and changing the stroke of said at least one roller from a minimal stroke to a maximum stroke; and said varying means comprising means for transmitting a pendulum motion to at least one portion of said means for displacing during the running of said printing press and rotation of said at least one roller.

12. The apparatus, according to claim 11, wherein:

said means for transmitting a pendulum motion comprises crank means, said crank means comprising a shaft having an axis of rotation;

said means for transmitting a pendulum motion comprising two contact surfaces;

said two contact surfaces being connected to said crank means;

said means for transmitting further comprises a swinging lever;

said crank means being connected to said swinging lever; and said two contact surfaces comprising means for receiving a pendulum motion and imparting a motion.

13. The apparatus, according to claim 12, wherein said crank means comprises means for accepting a pendulum motion from said two contact surfaces and converting the accepted pendulum motion to a linear stroke motion to be imparted to said at least one roller.

14. The apparatus, according to claim 13, wherein:

said means for transmitting comprises at least one contact roller, said at least one contact roller having an axis of rotation, the rotational axis of said at least one contact roller being disposed essentially perpendicularly with respect to the rotational axis of said at least one roller; and said at least one contact roller being disposed between said two contact surfaces and being disposed immediately adjacent at least one of said two contact surfaces.

15. The apparatus, according to claim 14, wherein said two contact surfaces comprise two planar contact surfaces, said two planar contact surfaces being disposed substantially in parallel with respect to one another.

16. The apparatus, according to claim 15, wherein:

said at least one roller comprises one roller;

said one roller comprises a roller shaft;

said roller shaft having a longitudinal axis concentric with the rotational axis of said one roller;

said roller shaft comprises a first end and a second end;

said first end of said roller shaft is attached to said one roller;

said apparatus further comprises a housing being mounted about said roller shaft;

said shaft of said crank means comprises a pivot shaft, said pivot shaft being disposed in and rotationally mounted to said housing;

said swinging lever comprising a first portion, a second portion, and a central portion, said central portion being disposed between said first and second portions of said swinging lever; and said swinging lever being rotatably connected to said pivot shaft at said central portion of said swinging lever.

17. The apparatus, according to claim 16, wherein:

said means for transmitting further comprises gear means;

said gear means comprising a first portion and a second portion;

said first portion of said gear means comprising an outer surface, said outer surface of said first portion of said gear means comprising teeth;

said first portion of said gear means being mounted about said second end of said roller shaft and having an axis of rotation being concentric with the axis of rotation of said roller shaft;

said second portion of said gear means comprising an outer surface, said outer surface of said second portion of said gear means comprising teeth;

said second portion of said gear means being mounted on a shaft and having an axis of rotation;

said shaft being a gear shaft having an axis of rotation and said gear shaft being rotatably mounted in said housing;

the axis of rotation of said second portion of said gear means being concentric with the axis of rotation of said gear shaft; and said teeth of said first portion and said second portion of said gear means being in mesh.

18. The apparatus, according to claim 7, wherein said gear means comprises a worm gear.

19. The apparatus, according to claim 18, wherein:

said crank means comprises means for connecting said second portion of said gear means to said swinging lever;

said connecting means comprises a connecting rod, said connecting rod comprising a first end and a second end;

said first end of said connecting rod comprises a first connecting pin and said second end of said connecting rod comprises a second connecting pin;

said first end and said second end of said connecting rod each having an axis of rotation;

said first connecting pin being for connecting said first end of said connecting rod to said second portion of said gear means;

said first connecting pin having a longitudinal axis, the longitudinal axis of said first connecting pin being concentric with the axis of rotation of said first end of said connecting rod;

said first connecting pin being eccentrically offset from the axis of rotation of said second portion of said gear means;

said second connecting pin being for connecting said second end of said connecting rod to said second portion of said swinging lever;

said second connecting pin having a longitudinal axis, the longitudinal axis of said second connecting pin being concentric with the axis of rotation of said second end of said connecting rod; and said second connecting pin being eccentrically offset from the axis of rotation of said swinging lever.

20. The apparatus, according to claim 19, wherein:

said roller shaft comprises a contact roller support;

said means for varying the stroke of said one roller comprises means for displacing end guiding said contact roller support perpendicularly with respect to the rotational axis of said one roller;

said means for guiding comprising a guide rail;

said contact roller support being disposed on said guide rail;

said at least one contact roller being connected to said contact roller support;

said means for varying the stroke of said one roller comprises a pneumatic cylinder apparatus;

said pneumatic cylinder apparatus comprising a thrust rod, said thrust rod having a path of movement and being connected to said contact roller support;

said means for varying the stroke further comprises adjustable stop means, said stop means being for delimiting the path of movement of said thrust rod of said pneumatic cylinder apparatus;

said stop means comprises a first stop and a second stop, said second stop being adjustable for adjusting the stroke of said one roller;

said second stop comprises a first end, a second end, and a helically threaded spindle, said spindle being disposed between said first end and said second end of said second stop;

said first end of said second stop for abutting said contact roller support and limiting the path of movement of said thrust rod in at least one direction of movement along the path of movement and varying the stroke of said one roller;

said second end of said second stop comprises an outer circumferential surface, said surface comprising teeth;

said stop means further comprising means for adjusting said second stop;

said means for adjusting said second stop comprising a gear, said gear having teeth, and said teeth of said gear being in mesh with said teeth of said second end of said second stop;

said gear being driven by means for driving, said means for driving comprising a servomotor;

said one roller comprises a distributor roller; and said printing press further comprises an inking unit for providing ink to said distributor roller.

21. Device for axially reciprocating at least one cylinder of a printing machine, said device for adjusting the stroke length of said at least one cylinder, from a minimum to a maximum stroke, during the machine run comprising:

a roller;

a roller holding structure;

a machine side frame;

said roller holding structure being mounted on said machine side frame;

two contact surfaces;

said two contact surfaces being disposed to be parallel to each other;

said roller being movable between said two contact surfaces;

said roller holding structure and said roller being movable transverse to the longitudinal axis of said at least one cylinder;

a crank type swing being disposed to permit a pendulum motion about a point of rotation;

adjusting structure;

said adjusting structure being disposed to relatively move said roller with respect to and between said two contact surfaces to relatively move said roller between the point of rotation and a maximum stroke.

22. The device according to claim 21 further comprising:

a housing;

said housing being disposed to make contact with said at least one cylinder;

said point of rotation being disposed in said housing;

a gear;

a connecting rod;

said connecting rod connecting said gear and said crank-type swing;

said crank-type swing being configured to execute an oscillating motion with said gear.

23. The device according to claim 22 further comprising:

a guide rail having a longitudinal axis;

said guide rail longitudinal axis being perpendicular to the longitudinal axis of said at least one cylinder;

said roller holding structure being connected to said guide rail to permit said roller to be movable along said guide rail;

a pneumatic cylinder;

said pneumatic cylinder being connected to said roller holding structure to move said roller between the point of rotation and a maximum stroke;

a fixed stop being disposed to stop said roller at a first point;

an adjustable stop; and said adjustable stop being disposed to adjust the stroke of said roller to thus adjust the stroke of said at least one cylinder.

24. The device according to claim 23 further comprising:

a servomotor;

two spur gears;

said adjustable stop comprising a threaded spindle; and said servomotor connected to said threaded spindle by said spur gears.

* * * * *

UNITED STATES PATENT AND TRADEMARK OFFICE

CERTIFICATE OF CORRECTION

PATENT NO. : 5,619,922

DATED : April 15, 1997

INVENTOR(S) : Carsten KELM

It is certified that error appears in the above-identified patent and that said Letters Patent is hereby corrected as shown below:

In column 6, line 21, after the second occurrence of 'of', delete "e" and insert --a--.

In column 7, line 33, after 'side', delete "free" and insert --frame--.

In column 8, line 7, after 'No.', delete "4,332,192," and insert --4,332,195,--.

In column 13, line 59, Claim 20, after 'displacing', delete "end" and insert --and--.

Signed and Sealed this

Twenty-second Day of July, 1997

Bruce Lehman

*Attest:*

BRUCE LEHMAN

*Attesting Officer*

*Commissioner of Patents and Trademarks*